US005104104A

United States Patent [19]

Mol

[11] Patent Number: 5,104,104

[45] Date of Patent: Apr. 14, 1992

[54] WEB PROCESSING APPARATUS

[75] Inventor: Hans C. Mol, Wilton, Conn.

[73] Assignee: Pitney Bowes Inc., Stamford, Conn.

[21] Appl. No.: 629,958

[22] Filed: Dec. 19, 1990

[51] Int. Cl.[5] ..... B65H 41/00

[52] U.S. Cl. ..... 270/52.5; 270/52

[58] Field of Search ..... 270/18, 19, 21.1, 41, 270/52, 52.5; 226/2, 74, 172

[56] References Cited

U.S. PATENT DOCUMENTS

| | | | |
|---|---|---|---|
| 3,556,509 | 1/1971 | Crum | 270/52 |
| 4,118,022 | 10/1978 | Rayfield | 270/52.5 |
| 4,179,107 | 12/1979 | Harris | 270/52 |
| 4,577,789 | 3/1986 | Hofmann | 270/52.5 |
| 4,593,893 | 6/1986 | Suter | 270/52.5 |

FOREIGN PATENT DOCUMENTS

| | | | |
|---|---|---|---|
| 2435049 | 2/1975 | Fed. Rep. of Germany | 270/52 |
| 2383872 | 11/1978 | France | 270/52 |
| 81054 | 5/1982 | Japan | 270/52 |

*Primary Examiner*—Edward K. Look

*Assistant Examiner*—Therese M. Newholm

*Attorney, Agent, or Firm*—Donald P. Walker; Melvin J. Scolnick; David E. Pitchenik

[57] ABSTRACT

Apparatus for processing an elongate portion of a web of sheets, wherein the web portion includes a plurality of uniformly dimensioned successive sheets bordered by an elongate marginal edge having a plurality of sprocket holes formed therein at equal intervals along its length, the apparatus comprising: structure for guiding the web portion in a downstream path of travel, the guiding structure including a pair of spaced apart idler rollers and a timing belt endlessly looped about the rollers, the belt including a plurality of sprockets extending outwardly therefrom at said equal intervals, the belt including a belt run aligned with the path of travel, the web portion sprocket holes disposed in meshing engagement with the belt run sprockets for guiding the web portion in the path of travel; and structure downstream from the guiding structure for feeding the web portion downstream in the path of travel against an upstream force exerted thereagainst by the guiding structure.

25 Claims, 2 Drawing Sheets

WEB PROCESSING APPARATUS

BACKGROUND OF THE INVENTION

This invention is generally concerned with web processing apparatus and more particularly with apparatus for processing elongate portions of a web of coded sheet.

As shown in U.S. Pat. No. 4,593,893 for a Method And Apparatus for Sequentially Advancing And Cutting Forms From Two Continuous Web Forms, issued June 10, 1986 to Walter Suter, apparatus has been provided for processing overlapped portions of a web of coded sheets, wherein each of the web portions includes a single marginal edge having sprocket holes formed therein, utilizing tractor structure which engages the sprocket holes of the marginal edge of each web portion for independently advancing the web portions on a table to cutting structure, cutting the web portions, and sorting the sheets cut from the web in accordance with the codes marked thereon.

Thus it is known in the art to provide tractor structures for independently feeding separated portions of a web of coded sheets downstream in overlapped paths of travel to cutting structure, cutting the sheets from the web and sorting the cut sheets in accordance with their codes. However, it has been found that rapidly accelerating and decelerating a web portion solely by means of tractor structure which engages only one marginal edge, results in the tractor structure having a tendency to tear the sprocket holes. Moreover, when the marginal edge is defined by a perforate line formed in the web portion, the tractor structure tends to separate the marginal edge from the web portion.

Accordingly:

An object of the invention is to provide improved web processing apparatus;

Another object is to utilize tractor structures for aligning separated web portions of a web of sheets;

Another object is to provide improved apparatus for processing a web of coded sheets, including structure for feeding separated portions of the length of the web in engagement with tractor structure for guiding the web portions in separate paths of travel; and Yet another object is to provide apparatus for feeding an elongate portion of a web of sheets downstream in a path of travel from guiding means, against the upstream force exerted by the guiding means.

SUMMARY OF THE INVENTION

Apparatus for processing an elongate portion of a web of sheets, wherein the web portion includes a plurality of uniformly dimensioned successive sheets bordered by an elongate marginal edge having a plurality of sprocket holes formed therein at equal intervals along its length, the apparatus comprising: means for guiding the web portion in a downstream path of travel, the guiding means including a pair of spaced apart idler rollers and a timing belt endlessly looped about the rollers, the belt including a plurality of sprockets extending outwardly therefrom at said equal intervals, the belt including a belt run aligned with the path of travel, the web portion sprocket holes disposed in meshing engagement with the belt run sprockets for guiding the web portion in the path of travel; and means downstream from the guiding means for feeding the web portion downstream in the path of travel against an upstream force exerted thereagainst by the guiding means.

BRIEF DESCRIPTION OF THE DRAWINGS

As shown in the drawings wherein like references numerals designate like or corresponding parts throughout the several views.

DESCRIPTION OF THE PREFERRED EMBODIMENTS

Figure 1:
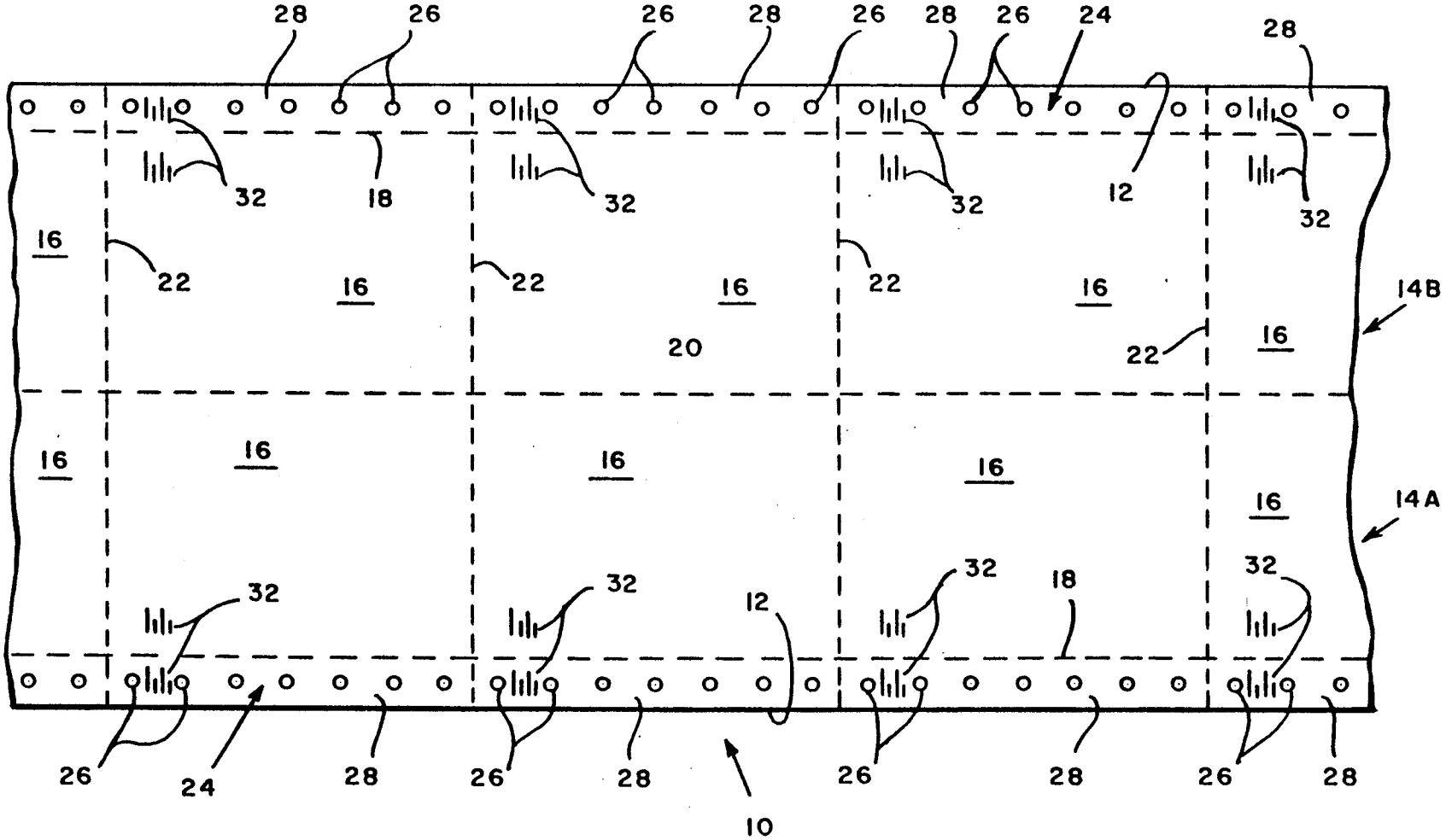
FIG. 1 is a fragmentary plan view of a typical web of sheets.

As shown in FIG. 1, an elongate web 10, of the type which may be processed in accordance with the invention, generally comprises an elongate web of paper having opposed, longitudinally-extending, side edges 12. The web 10 comprises two longitudinally-extending, parallel-spaced, web portions, 14A and 14B, each of which includes a plurality of successive, uniformly dimensioned, sheets 16 defined therein. For discussion purposes, the sheets 16 are shown to be serially defined in the web 10 by means of a pair of parallel-spaced, longitudinally-extending, perforate side lines 18, by means of a longitudinally-extending perforate center line 20 located substantially midway between the side lines 18, and by means of a plurality of transversely-extending, parallel-spaced, perforate lines 22, located at equal intervals longitudinally of the length of the web 10. The side edges 12 and perforate side lines 18 additionally define a pair of parallel-spaced marginal edges 24, each of which has a plurality of sprocket holes 26 formed therein at equal intervals longitudinally of its length. And, each adjacent pair of the transverse perforate lines 22 defines a pair of opposed portions 28 of the marginal edges 24, each of which borders a sheet 16 of one of the web portions, 14A or 14B. Thus each of the elongate web portions, 14A or 14B, includes a plurality of successive sheets 16 and a single marginal edge 24 which includes a portion 28 thereof bordering each sheet 16 of the web portion, 14A or 14B.

Notwithstanding the foregoing, it is noted that perforate side lines 18 (FIG. 1) are not typically provided. Moreover, without departing from the spirit and scope of the invention, rather than perforate lines, 18 or 20, the lines 18 or 20 may be marked on the web 10. Moreover, each of the sheets preferably includes a sheet processing code 32 marked thereon or on the marginal edge portion 28 bordering each sheet 16.

Figure 2:
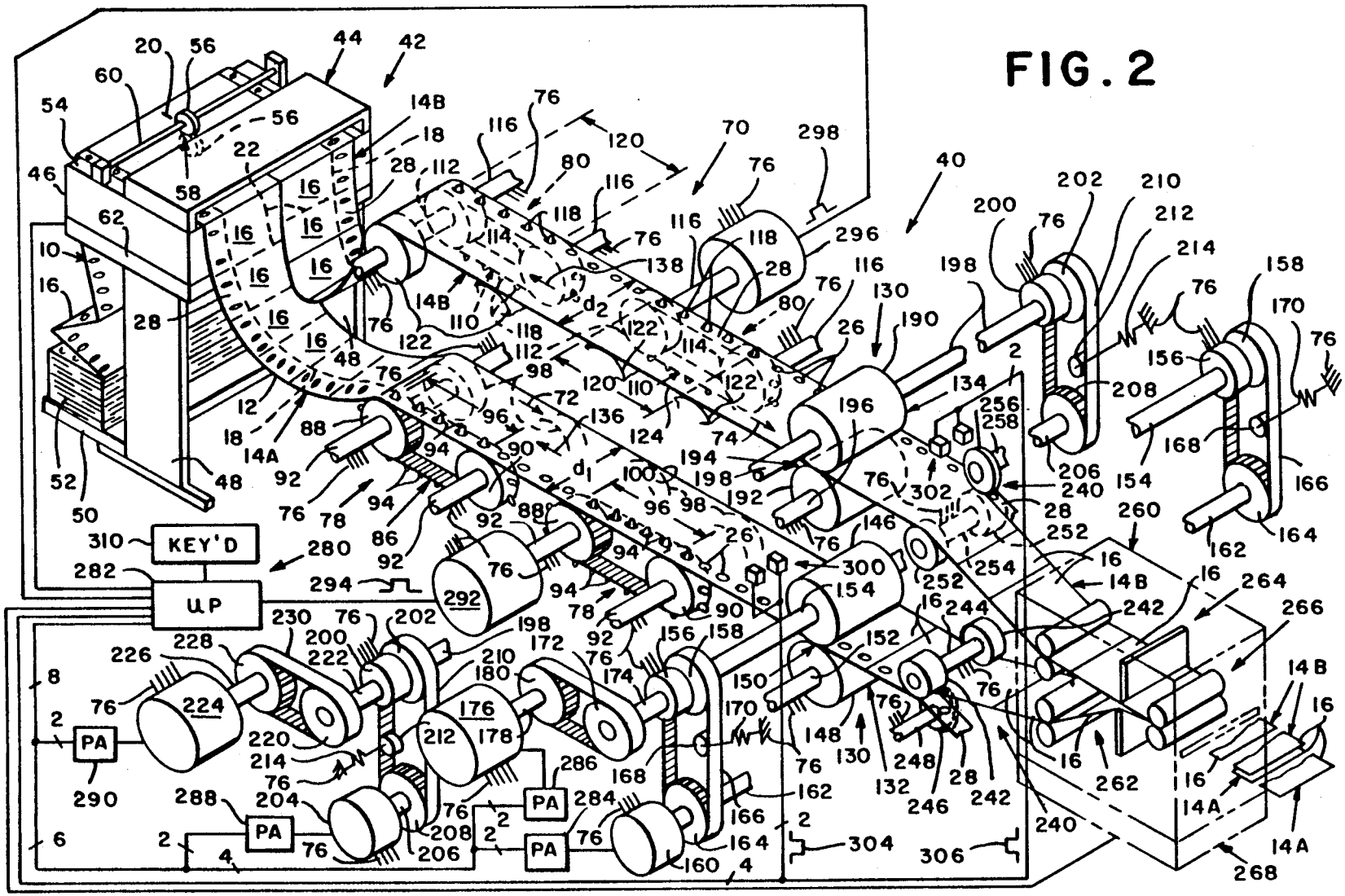
FIG. 2 is a schematic perspective view of web processing apparatus according to the invention.

As shown in FIG. 2, according to the invention there is provided apparatus 40 for processing a web 10 of coded sheets 16. The sheet processing apparatus 40 generally includes any conventional structure 42 for separating the elongate web portions, 14A and 14B, from each other along the center line 20 extending lengthwise of the web 10. The separating structure 42 preferably includes stand-alone web feeding and cutting structure 44 comprising a web feeding module 46 supported by a pair of upright, parallel-spaced, legs 48, and a shelf 50 laterally extending from the legs 48 for supporting the web 10 in a fan-folded stack 52. The web feeding module 46 includes a conventional, horizontally-extending, cutting table 54. And, the web feeding and cutting structure 44 includes a pair of conventional, opposed, rotatable, cutting members 56, defining a web cutting nip 58 therebetween, which is located at the level of the cutting table 54. The cutting members 56 are suitably rotatably connected to the feeding module 46, as by means a pair of parallel-spaced shafts 60, one of which is shown, for disposition in cutting relationship with the centerline 20 of the web 10. In addition, the web feeding module 46 includes conventional structure 62 for controlling the module 46, for intermittently feeding the web 10 upwardly from the fan-folded stack 52 and then across the cutting table 54, where the web 10 is fed into the web cutting nip 58 between the cutting members 56 to separate the elongate web portions, 14A and 14B, from the web 10, and for intermittently feeding the web portions, 14A and 14B, from the feeding module 46 for further processing.

Downstream from the web feeding and cutting structure 44 (FIG. 2), the web processing apparatus 40 preferably includes structure 70 for guiding the separated web portions, 14A and 14B, in separate, horizontally-extending, overlapping, parallel-spaced, downstream paths of travel, 72 and 74. The guiding structure 70 includes conventional framework 76 for supporting the various components thereof and includes at least one, and preferably a plurality of, such as two, tractor structures 78 for guiding the web portion 14A in the path of travel 72, and tractor structures 80 for guiding the web portion 14B in the path of travel 74.

The tractor structures 78 (FIG. 2) each include a timing gear belt 86 which is endlessly looped about a pair of upstream and downstream idler pulley gear rollers, 88 and 90. And, each pair of idler rollers, 88 and 90, is conventionally mounted for rotation on a pair of parallel-spaced idler shafts 92 which are conventionally rotatably connected to the framework 76. Each of the timing belts 86 includes a plurality of sprockets 94 outwardly protruding therefrom at equally spaced intervals, longitudinally of the length thereof, which correspond to the spacing between the sprocket holes 26 (FIG. 1) formed in the marginal edges 28 of the web 10. In addition, each of the timing belts 86 (FIG. 2) includes a horizontally-extending belt run 96, which is aligned with the path of travel 72. And the marginal edge 28 of the web portion 14A is disposed in meshing engagement with the belt runs 96, i.e., the marginal edge sprocket holes 26 are disposed in meshing engagement with the belt run sprockets 94, for aligning the web portion 14A in the path of travel 72. Moreover, each of the idler shafts 92 has mounted thereon an idler roller 98 for supporting the web portion 14A, alongside of the edge 100 of the web portion 14A which is opposite the marginal edge 28 thereof, in the path of travel 72.

The tractor structures 80 (FIG. 2) each include a timing gear belt 110 which is endlessly looped about a pair of upstream and downstream idler pulley gear rollers, 112 and 114. And, each pair of idler rollers, 112 and 114, is conventionally mounted for rotation on a pair of parallel-spaced idler shafts 116 which are conventionally rotatably connected to the framework 76. Each of the timing belts 110 includes a plurality of sprockets 118 outwardly protruding therefrom at equally spaced intervals, longitudinally of the length thereof, which correspond to the spacing between the sprocket holes 26 (FIG. 1) formed in the marginal edges 28 of the web 10. In addition, each of the timing belts 110 (FIG. 2) includes a horizontally-extending belt run 120, which is aligned with the path of travel 74. And the marginal edge 28 of the web portion 14B is disposed in meshing engagement with each of the belt runs 120, i.e., the marginal edge sprocket holes 26 are disposed in meshing engagement with the belt run sprockets 118, for aligning the web portion 14B in the path of travel 74. Moreover, each of the idler shafts 116 has mounted thereon an idler roller 122 for supporting the web portion 14B, alongside of the edge 124 of the web portion 14B which is opposite the marginal edge 28 thereof, in the path of travel 74.

Downstream from the web guiding structure 70 (FIG. 2) the web processing apparatus 40 preferably includes structure 130 for independently feeding the separated web portions, 14A and 14B, in their respective, horizontally-extending, overlapping, parallel-spaced, downstream paths of travel, 72 and 74. The web portions feeding structure 130 includes the conventional framework 76 for supporting the various components thereof and includes separate feed roller structures, 132 and 134, for intermittently engaging and feeding the respective web portions, 14A and 14B, downstream against respective upstream forces, 136 and 138, exerted thereagainst by the respective tractor structures, 78 and 80.

The feed roller structure 132 (FIG. 2) includes a pair of elongate, parallel-spaced, upper and lower feed rollers, 146 and 148, which are rotatably attached to the framework 76 so as to extend transverse to the path of travel 72 of the web portion 14A and to define therebetween an elongate nip 150, for receiving the web portion 14A. The nip 150 spans the entire transverse width dimension "$d_1$" of the web portion 14A. The lower roller 148 is preferably rotatably attached to the framework 76 by means of an elongate idler shaft 152, on which the lower roller 148 is coaxially mounted and which is conventionally journaled to the framework 76 for axial rotation. To prevent the web portion 14A from being laterally moved out of the path of travel 72 by the feed rollers, 146 and 148, the upper roller 146 is preferably rotatably attached to the framework 76 by means of an elongate shaft 154, on which the upper roller 146 is coaxially mounted and which is eccentrically rotatable relative to the framework 76 by means of opposed collar members 156 conventionally rotatably connected to the framework 76, to permit opening and closing the nip 150. Thus, the upper roller 146 is both axially and eccentrically rotatable, whereby the upper roller 146 may be intermittently raised and lowered relative to the lower roller 148 for moving the upper rollers 146 into and out of feeding engagement with the web portion 14A.

For axially rotating the shaft 154 (FIG. 2) within the collar members 156, the feed roller structure 132 includes a pair of timing pulley gears 158 coaxially connected to opposite ends of the shaft 154. And, for driving the timing pulley gears 158, the feed roller structure 132 includes a suitable d.c. motor 160, which is conventionally connected to the framework 76, an elongate output drive shaft 162 driven by the motor 160, a pair of timing pulley gears 164 which are spaced apart from one another and coaxially mounted on the drive shaft 162 so as to be disposed in alignment with the timing pulley gears 158, and a pair of timing gear belts 166 which are respectively endlessly looped about and disposed in meshing engagement with one of each of the timing pulley gears, 158 and 164. To facilitate eccentric movement of the upper roller 146 relative to the lower roller 148, the feed roller structure 132 may optionally includes a pair of belt tensioning pulley gears 168 disposed in meshing engagement with the respective belts 166, and a pair of tension springs 170 which each have one end conventionally connected to the framework 76 and the other end conventionally connected to one of the belt tensioning pulley gears 168. In this connection, it is noted that since the nip 150 between the upper and lower rollers 146 and 148 need be opened merely three to ten thousandths of an inch to permit moving the upper roller 146 out of feeding engagement with the thickest stock of paper from which the web portion 14A is fabricated, the tensioning pulley gears 168 and springs 170 are not ordinarily needed.

Moreover, for eccentrically rotating the upper roller 146 (FIG. 2), the feed roller structure 132 includes a timing pulley gear 172, which is conventionally connected by means of a shaft 174 to one of the collar members 156 for eccentric rotation thereof. And, for driving the timing pulley gear 172, the feed roller structure 132 includes a suitable d.c. motor 176, which is conventionally connected to the framework 76, an output drive shaft 178 driven by the motor 176, a timing pulley gear 180 coaxially mounted on the shaft 178 so as to be disposed in alignment with the timing pulley gear 172, and a timing gear belt 182 which is endlessly looped about the timing pulley gears, 172 and 180.

The feed roller structure 134 (FIG. 2) includes a pair of elongate, parallel-spaced, upper and lower feed rollers, 190 and 192, which are rotatably attached to the framework 76 so as to extend transverse to the path of travel 74 of the web portion 14B and to define therebetween an elongate nip 194, for receiving the web portion 14B. The nip 194 spans the entire transverse width dimension "$d_2$" of the web portion 14B. The lower roller 192 is preferably rotatably attached to the framework 76 by means of an elongate idler shaft 196, on which the lower roller 192 is coaxially mounted and which is conventionally journaled to the framework 76 for axial rotation. To prevent the web portion 14B from being laterally moved out of the path of travel 74 by the feed rollers, 190 and 192, the upper roller 190 is preferably rotatably attached to the framework 76 by means of an elongate shaft 198, on which the upper roller 190 is coaxially mounted and which is eccentrically rotatable relative to the framework 76 by means of opposed collar members 200 conventionally rotatably connected to the framework 76, to permit opening and closing the nip 194. Thus, the upper roller 190 is both axially and eccentrically rotatable whereby the upper roller 190 may be intermittently raised and lowered relative to the lower roller 192 for moving the upper roller into and out of feeding engagement with the web portion 14B.

For axially rotating the shaft 198 (FIG. 2) within the collar members 200, the feed roller structure 134 includes a pair of timing pulley gears 202 coaxially connected to opposite ends of the shaft 198. And, for driving the timing pulley gears 202, the feed roller structure 134 includes a suitable d.c. motor 204, which is conventionally connected to the framework 76, an elongate output drive shaft 206 driven by the motor 204, a pair of timing pulley gears 208 which are spaced apart from one another and coaxially mounted on the drive shaft 206 so as to be disposed in alignment with the timing pulley gears 202, and a pair of timing gear belts 210 which are respectively endlessly looped about and disposed in meshing engagement with one of each of the timing pulley gears, 202 and 208. To facilitate eccentric movement of the upper roller 190 relative to the lower roller 192, the feed roller structure 132 may optionally include, a pair of belt tensioning pulley gears 212 disposed in meshing engagement with the respective gear belts 210, and a pair of tension springs 214 which each have one end conventionally connected to the framework 76 and the other end conventionally connected to one of the belt tensioning pulley gears 212. In this connection it is noted that since the nip 194 between the upper and lower rollers, 190 and 192, need be opened merely three to ten thousandth of an inch to permit moving the upper rollers 190 out of feeding engagement with the thickest stock of paper from which the, web portion 14B is fabricated, the tensioning pulley gears 212 and springs 214 are not ordinarily needed.

Moreover, for eccentrically rotating the upper roller 202 (FIG. 2), the feed roller structure 134 includes a timing pulley gear 220, which is conventionally connected by means of a shaft 222 to one of the collar members 200 for eccentric rotation thereof. And, for driving the timing pulley gear 220, the feed roller structure 134 includes a suitable d.c. motor 224, which is conventionally connected to the framework 76, an output drive shaft 226 driven by the motor 224, a timing pulley gear 228 coaxially mounted on the shaft 226 so as to be disposed in alignment with the timing pulley gear 220, and a timing gear belt 230 which is endlessly looped about the timing pulley gears, 220 and 228.

Downstream from the web portions feeding structure 130 (FIG. 2), the web processing apparatus 40 preferably includes structure 240 for separating the marginal edges 28 from the web portions, 14A and 14B. The edge separation structure 240 may include any conventional structure for performing the separation function. Preferably for separating the marginal edge 28 from the web portion 14A, there is provided a suitable pair of parallel-spaced guide rollers 242, which are conventionally rotatably connected to the framework 76 by means of an idler shaft 244 for disposition of the rollers 242 in overhanging relationship with the web portion 14A, alongside of the opposed edges, 12 and 100. And, there is provided a suitable cutting member 246, which is conventionally rotatably connected to the framework 76 by means of an idler shaft 248 for disposition in alignment with one of the rollers 242, beneath the web portion 14A and in cutting relationship with the elongate perforate line, or mark, 18 defining the marginal edge 28. Moreover, for separating the marginal edge 28 from the web portion 14B there is provided a suitable pair of parallel-spaced spaced guide rollers 252, which are conventionally rotatably connected to the framework 76 by means of an idler shaft 254 for disposition of the rollers 252 in supporting relationship with the web portion 14B, alongside of the opposed edges, 12 and 100. And, there is provided a suitable cutting member 256, which is conventionally rotatably connected to the framework 76 by means of an idler shaft 258 for disposition in alignment with one of the rollers 252, above the web portion 14B and in cutting relationship with elongate perforate line, or mark, 18 defining the marginal edge 28.

Further, downstream from the marginal edge separating structure 240 (FIG. 2), the web processing apparatus 40 includes conventional structure 260 for individually separating successive sheets from the web portions, 14A and 14B, including, for example, two pairs of input feed rollers 262, for respectively independently feeding the web portions, 14A and 14B, from the marginal edge separating structure 240, a pair of opposed and reciprocally movable cutting knives 264, for independently successively cutting respective successive sheets 16 from either or both of the respective web portions, 14A and 14B, a pair of output feed rollers 266 for feeding respective sheets 16 from the sheet separating structure 260, and thus from the sheet processing apparatus 40, and, suitable structure 268 for controlling the various components 262, 264 and 266 of the sheet separating structure 260.

In addition, there is provided conventional structure 280 (FIG. 2) for controlling the web processing apparatus 40 including, for example, a conventional microprocessor 282, and a plurality of power amplifiers, 284, 286, 288 and 290 for respectively interfacing the motors 160, 176, 204 and 224 with the microprocessor 282. In addition, the control structure 280 includes a conventional encoder 292, which is suitably connected to the microprocessor 292 and to one of the idler shafts 92 of the tractor structure 78, for providing signals, such as the signal 294, to the microprocessor 282 which correspond to respective increments of linear displacement of the web portion 14A as the web portion 14A is fed downstream in the path of travel 72. Moreover, the control structure 280 includes a conventional encoder 296, which is suitably connected to the microprocessor 292 and to one of the idler shafts 116 of the tractor structure 80, for providing signals, such as the signal 298, to the microprocessor 292 which correspond to respective increments of linear displacement of the web portion 14B as the web portion 14B is fed downstream in the path of travel 74. In addition, the control structure 280 is conventionally connected in serial or parallel communication with the web portions separating structure 42 and with the sheet separating structure 260, for control thereof from the microprocessor 282. Still further, the control structure 280 includes a pair of conventional sensing structures, 300 and 302 which are respectively suitably connected to the framework 76 for disposition in code sensing relationship with the codes 32 (FIG. 1) marked on either the respective marginal edges 28 or sheets 16 of the web portions, 14A and 14B, for providing suitable signals, such as the signals, 304 and 306, which correspond to the respective codes 32 to the microprocessor 282. Moreover, the microprocessor 282 is conventionally programmed for calculating the linear distance between successive sheets 16, based upon said web portion displacement signals, 294 and 298. Further, the microprocessor 282 is conventionally programmed to cause the web portions separation structure 42, web portions feeding structure 130 and sheet cutting structure 260 to respectively timely feed the web 10, independently timely feed web portions, 14A and 14B, and independently timely cut sheets 16 from either or both of the web portions, 14A and 14B, in accordance with the calculations of the linear distance between successive sheets 16, and thus in accordance with the displacement signals, 294 and 298, and in accordance with the codes 32 on the marginal edges 28, or sheets 16 of the web portions, 14A and 14B, and in accordance with conventional operator input from a suitable keyboard 310 which is conventionally connected in serial or parallel communication with the microprocessor 282.

In accordance with the objects of the invention there has been described improved apparatus for processing a web of coded sheets, including structure for feeding separated portions of the length of the web in engagement with tractor structure for guiding the web portions in separate paths of travel.

What is claimed is:

1. Apparatus for processing an elongate portion of a web of sheets, wherein the web portion includes a plurality of uniformly dimensioned successive sheets bordered by an elongate marginal edge having a plurality of sprocket holes formed therein at equal intervals along its length, the apparatus comprising:

a. means for guiding the web portion in a downstream path of travel, the guiding means including a pair of spaced apart idler rollers and a timing belt endlessly looped about the rollers, the belt including a plurality of sprockets extending outwardly therefrom at said equal intervals, the belt including a belt run aligned with the path of travel, the web portion sprocket holes disposed in meshing engagement with the belt run sprockets for guiding the web portion in the path of travel; and b. means downstream from the guiding means for feeding the web portion downstream in the path of travel against an upstream force exerted thereagainst by the guiding means.

2. The apparatus according to claim 1, wherein the web portion has a predetermined width, and the feeding means including a pair of elongate feed rollers extending transverse to the path of travel and defining a nip therebetween which extends across the width of the web portion.

3. The apparatus according to claim 2 including means for driving one of the feed rollers.

4. The apparatus according to claim 1 including means downstream from the feeding means for progressively separating the marginal edge from the web portion.

5. The apparatus according to claim 1 including means downstream from the feeding means for successively separating sheets from the web portion.

6. The apparatus according to claim 1 including means for controlling the feeding means, and the controlling means including means for intermittently feeding the web portion.

7. The apparatus according to claim 2 including means for opening and closing the nip.

8. The apparatus according to claim 4 including means for successively cutting each sheet from the web portion after the marginal edge is separated from said sheet.

9. The apparatus according to claim 2 including means for controlling the feeding means, the controlling means including a microprocessor, and the controlling means including an encoder connected to one of the idler rollers for providing successive signals to the microprocessor corresponding to successive increments of linear displacement of the web portion.

10. The apparatus according to claim 2, wherein one of the feed rollers is a drive roller and the other feed roller is a driven roller, and the feeding means including means for raising and lowering one of the feed rollers.

11. The apparatus according to claim 10 including means for intermittently moving one of the feed rollers into and out of engagement with the web portion.

12. The apparatus according to claim 9 including means downstream from the feeding means for cutting successive sheets from the web portion, and the controlling means including means for causing the cutting means to cut the successive sheets from the web portion in accordance with the successive signals.

13. Apparatus for processing an elongate web of sheets, wherein the web comprises a pair of elongate marginal edges which each include sprocket holes formed therein at equal intervals lengthwise thereof, wherein the web comprises first and second elongate web portions which each include a plurality of successive sheets bordered by one of the marginal edges, the apparatus comprising:

a. means for separating the web portions from the web;

b. means for guiding the web portions, the guiding means including a first belt endlessly looped about a first pair of idler rollers, the guiding means including a second belt endlessly looped about a second pair of idler rollers, the first and second belts each including a plurality sprockets extending therefrom at said equal intervals lengthwise of the belt; and c. means for feeding the web portions from the guiding means, the feeding means including first means for feeding the first web portion downstream in a first path of travel wherein marginal edge sprocket holes thereof are disposed in engagement with sprockets of the first belt, and the feeding means including second means for feeding the second web portion downstream in a second path of travel wherein marginal edge sprocket holes thereof are disposed in engagement with sprockets of the second belt.

14. The apparatus according to claim 13 including a first encoder connected to one of the first pair of idler rollers for providing successive signals corresponding to successive increments of linear displacement of the first web portion.

15. The apparatus according to claim 13 including a second encoder connected to one of the second pair of idler rollers for providing successive signals corresponding to successive increments of linear displacement of the second web portion.

16. The apparatus according to claim 13, wherein the first feeding means includes a pair of elongate third rollers extending transverse to the first path of travel downstream from the first belt.

17. The apparatus according to claim 13, wherein the second feeding means includes a pair of elongate third rollers extending transverse to the second path of travel downstream from the second belt.

18. The apparatus according to claim 13, wherein the separating means includes means for lengthwise cutting the web for separating the web portions.

19. The apparatus according to claim 13 including means downstream from the feeding means for cutting successive sheets from the respective web portions.

20. The apparatus according to claim 16, wherein one of the third rollers is a drive roller and the other third rollers is a driven roller, and the first feeding means including means for raising and lowering one of the third rollers.

21. The apparatus according to claim 17, wherein one of the third rollers is a drive roller and one of the third rollers is a driven roller, and the second feeding means including means for raising and lowering one of the third rollers.

22. The apparatus according to claim 16, including means for intermittently moving one of the third rollers into and out of engagement with the first web portion.

23. The apparatus according to claim 17 including means for intermittently moving one of the third rollers into and out of engagement with the second web portion.

24. Apparatus for processing elongate first and second portions of a web of sheets, wherein each of the web portions includes an elongate marginal edge bordering a plurality of successive sheets, and each of the marginal edges includes a plurality of sprocket holes formed therein at equal intervals along the length thereof, the apparatus comprising:

a. means for independently guiding the first and second web portions in first and second paths of travel respectively, the guiding means including a first endless idler belt having a plurality of first sprockets extending outwardly therefrom, the first belt including a first belt run aligned with the first path of travel, the guiding means including a second endless idler belt having a plurality of second sprockets extending outwardly therefrom, the second belt including a second belt run aligned with the second path of travel, the marginal edge sprocket holes of the first web portions disposed in meshing engagement with first belt run sprockets for guiding the first web portion in the first path of travel, the marginal edge sprocket holes of the second web portion disposed in meshing engagement with second belt run sprockets for guiding the second belt portion in the second path of travel; and b. means downstream from the web portions guiding means for independently feeding the first and second web portions in the first and second paths of travel respectively.

25. The apparatus according to claim 24, wherein the feeding means feeds the first and second web portions downstream in the respective first and second paths of travel against upstream forces respectively exerted by the first and second belts.

* * * * *